United States Patent [19]

Atchisson

[11] 4,057,003

[45] Nov. 8, 1977

[54] OPEN BOLT CONVERSION APPARATUS

[76] Inventor: Maxwell G. Atchisson, 55 Old Yellow Springs Road, Apt. H, Fairborn, Ohio 45324

[21] Appl. No.: 645,362

[22] Filed: Dec. 30, 1975

[51] Int. Cl.[2] ..... F41D 5/04; F41D 11/02

[52] U.S. Cl. ..... 89/138; 89/128; 89/142

[58] Field of Search ..... 89/144, 142, 143, 138, 89/132

[56] References Cited

U.S. PATENT DOCUMENTS

| | | | |
|---|---|---|---|
| 2,383,487 | 8/1945 | Johnson | 89/142 X |
| 3,045,555 | 7/1962 | Stoner | 89/142 |
| 3,318,192 | 5/1967 | Miller et al. | 89/142 |
| 3,618,455 | 11/1971 | Plumer et al. | 89/132 |
| 3,715,954 | 2/1973 | Rude | 89/142 X |
| 3,724,325 | 4/1973 | Silsby | 89/142 X |
| 3,846,928 | 11/1974 | Ruger et al. | 89/138 X |
| 3,960,053 | 6/1976 | Conley | 89/149 |

*Primary Examiner*—David H. Brown
*Attorney, Agent, or Firm*—Jones, Thomas & Askew

[57] ABSTRACT

An open-bolt firing conversion for the standard M16 rifle, which allows the rifle to be converted to open-bolt firing by replacement of parts and without otherwise altering the rifle. The open-bolt conversion is hammer-fired for reliability and preservation of the cyclic firing rate, and the conversion hammer straddles the conversion sear within the conventional M16 lower receiver. The open-bolt converted rifle can fire either semiautomatic or full-automatic under control of the conventional firing selector lever.

The cyclic rate reducer is installed in a conventional M16 rifle, without further modification to the rifle, to lower the automatic fire cyclic rate to approximately 350 rounds per minute. The cyclic rate reducer includes an actuator assembly which is received behind a modified bolt carrier, and which is released to move forward and contact an automatic sear release only after the bolt carrier has completed at least a substantial portion of its forward movement. The actuator assembly includes provision for preventing the actuator assembly from bouncing rearwardly at the time of weapon recoil, before the gas-actuated rearward movement of the bolt carrier.

The variable vector muzzle compensator receives the high-pressure gases at the muzzle of a firearm, and channels these gases to provide a force vector in a selected direction perpendicular to the line of fire. The direction of the gas force vector can be adjusted to accommodate a particular shooter, and the compensator is particularly effective to reduce muzzle climb in fully-automatic firearms.

The multiple magazine apparatus includes a number of magazines bracketed together in a semi-permanent assembly, so that each loaded magazine is ready for insertion into a firearm as soon as the preceding magazine is emptied. Each individual magazine has provision for preventing the top round of the magazines not in the receiver housing from being dislodged when the firearm and the multiple magazine assembly recoil during firing. An auxiliary catch is provided to retain the magazines of the magazine assembly on the receiver of the firearm.

The night sight apparatus is easily and removably attachable to a conventional M16 rifle without replacement or modification of the conventional sights, and provides a luminous sighting reference for shooting during low levels of ambient light.

6 Claims, 21 Drawing Figures

OPEN BOLT CONVERSION APPARATUS

These inventions relate to improvements in the operation of fully-automatic firearms, and also relate to cartridge magazine apparatus, muzzle vector compensator apparatus, and sighting apparatus for use with firearms generally.

The conventional M16 rifle fires from a closed bolt, meaning that the bolt is closed and locked before the trigger is pulled. Closed bolt firing is undesirable under operating conditions in which the weapon is expected to undergo a substantial amount of full-auto firing. With the bolt always closed, cooling air cannot circulate into the chamber and a live round always remains in the hot chamber after firing. Occasionally a live round in the chamber of a closed-bolt weapon, such as the M16, can "cook off" or explode from the heat in the chamber, after a number of rounds have been fired in rapid succession.

Prior proposals for modifying the M-16 rifle to fire with an open bolt have generally required permanent modifications to the rifle, such as drilling or machining of parts, which is time-consuming and expensive, which must be accomplished in a machine shop facility, and which renders the firearm incapable of re-conversion to standard closed-bolt construction.

The standard M16 rifle has a full-auto cyclic firing rate of about 750 rounds per minute. Often it is desirable to lower the cyclic rate of fire in order to increase accuracy and to conserve ammunition. The cyclic rate of an automatic firearm is generally determined by a number of interrelated design features of the firearm, and it has been difficult heretofore to effectively and substantially reduce the cyclic rate without substantial permanent modification.

It is an object of the present invention to provide an improved open bolt conversion assembly for a fully-automatic firearm.

It is another object of the present invention to provide an open bolt firing conversion for the M16 rifle, without modification to the rifle other than substitution of parts.

It is another object of the present invention to reduce the cyclic firing rate of a fully-automatic firearm such as the M16.

It is another object of the present invention to reduce the muzzle climb of a firearm.

It is another object of the present invention to provide an improved multiple magazine assembly for firearms.

It is another object of the present invention to provide improved night sight apparatus for firearms.

The foregoing and other objects of the present invention will become more readily apparent from the following description of the disclosed embodiments as described with respect to the drawing, in which.

OPEN BOLT CONVERSION

Figure 1:
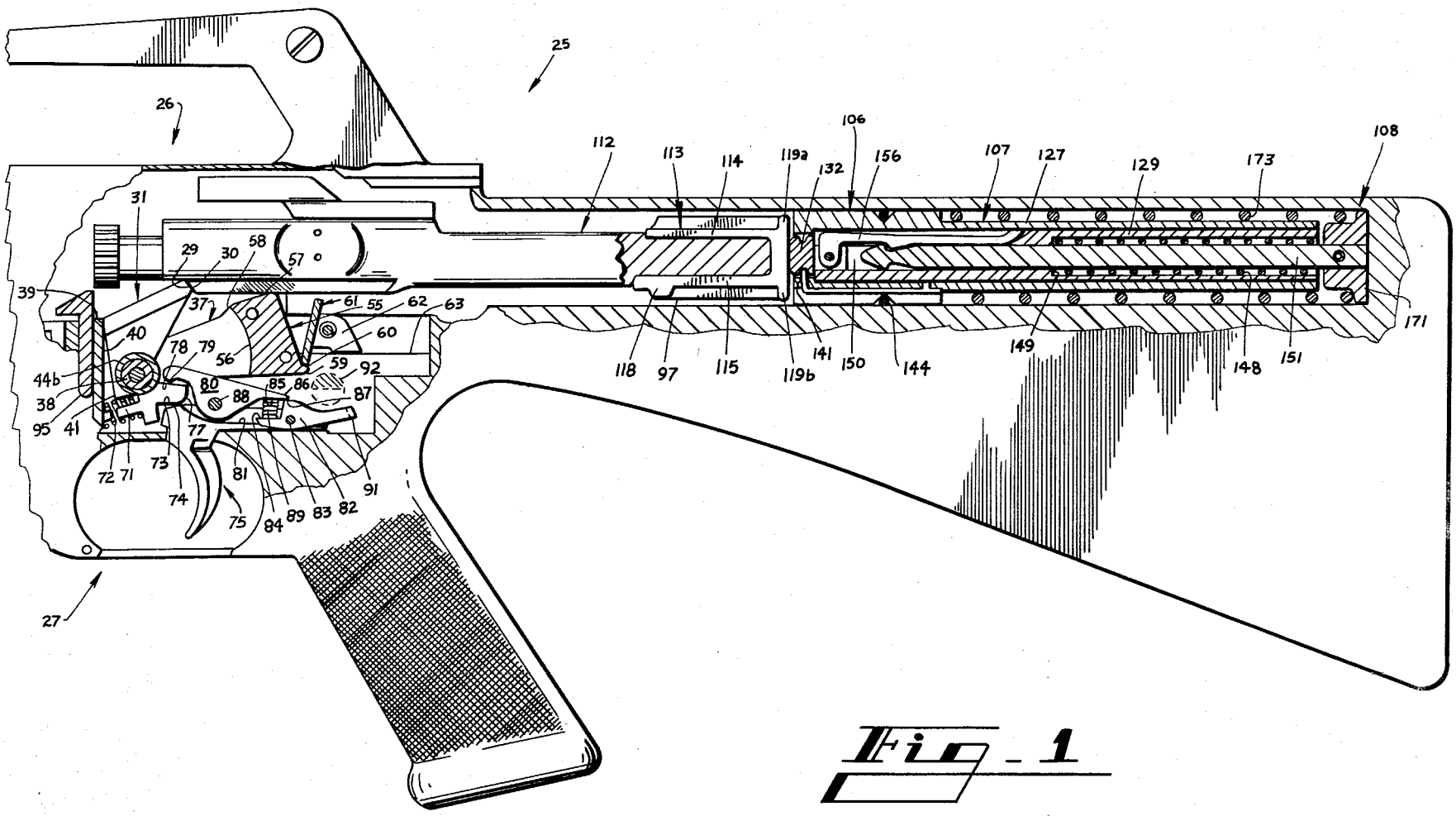
FIG. 1 shows a partially-sectioned side elevation view of an M16 rifle containing both the open bolt conversion apparatus and the cyclic rate reduction apparatus of the present invention.
Figure 2:
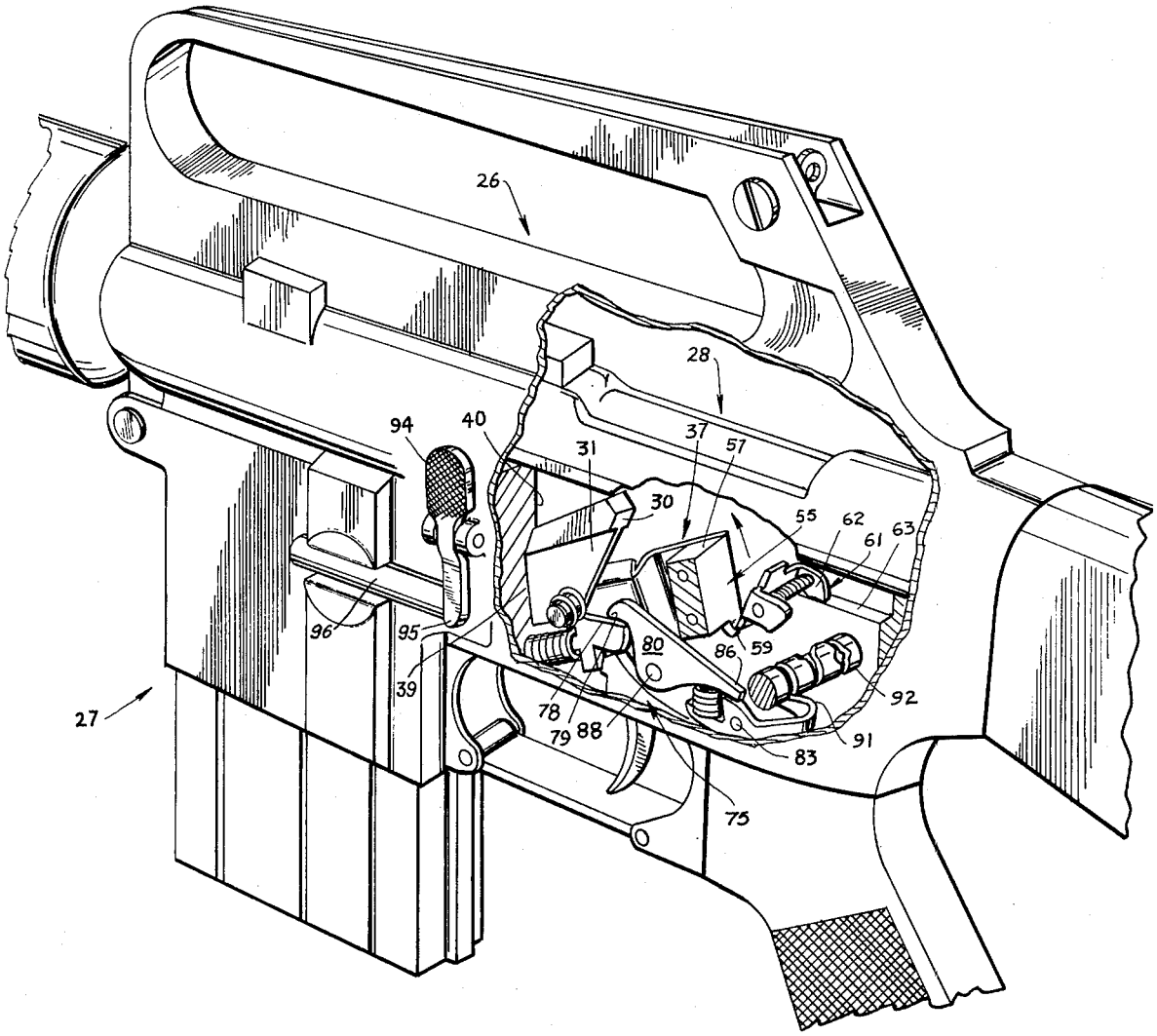
FIG. 2 is a pictorial view, partially broken away and partially sectioned, of the open-bolt firing apparatus of FIG. 1, with the bolt carrier moved forward into firing position.

Turning to the embodiment of open bolt conversion apparatus as shown in FIGS. 1–4, it will be recognized that such apparatus has been installed in an otherwise-conventional M16 rifle indicated generally at 25 and including an upper receiver section 26 and a lower receiver section 27. The bolt carrier 112 may be a conventional M16 bolt carrier with an angular surface 29 provided at the lower front portion of the bolt carrier to provide a contact surface which meets with the surface 30 of the sear 31. The bolt carrier 112 is depicted in the open and cocked position in FIG. 1, with the bolt assembly being urged forwardly to firing position by the coil action spring 173 and the action spring guide 106 (or with the conventional M16 buffer), and with the aforementioned contact of bolt surface 29 and sear surface 30 preventing the bolt from forward movement.

Figure 3:
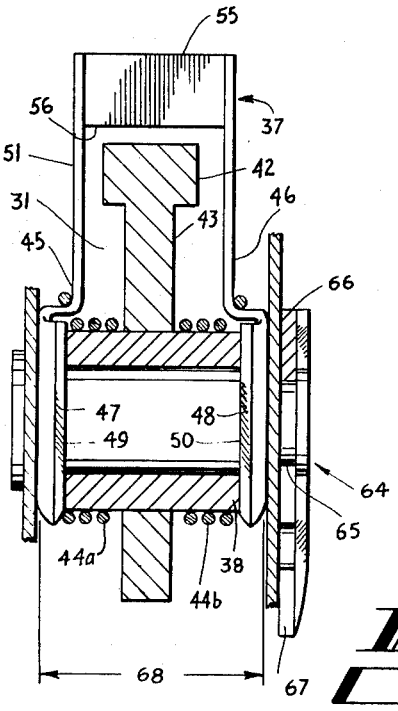
FIG. 3 is an end elevation view of the hammer and sear subassembly contained in the disclosed embodiment of the open bolt conversion.

The sear 31 is mounted concentrically with the hammer 37, with the sear having a hole that mates with the sear-hammer bushing 38. The sear 31 has a flat front surface 39 which rests against the front wall 40 of the lower receiver trigger housing recess, when the bolt carrier 112 is retained in the open position as shown in FIG. 1. A substantial part of the bolt carrier assembly impact against the sear, during sear engagement after recoil, is thus taken by the contact between the sear surface 39 and the receiver wall 40. The angular portion 41 of the sear 31 provides clearance for the sear to rotate during firing, as described below. As best seen in FIG. 3, the sear has a thick upper surface 42 to provide adequate strength for contact by the bolt carrier 112, while the lower portion 43 of the sear is relatively thin to allow room for the left hammer spring 44*a* and the right hammer spring 44*b* which surround the sear-hammer bushing 38 between the legs 45 and 46 of the hammer 37.

The legs 45 and 46 of the hammer may be thin sheet metal stampings and have inner surfaces 47 and 48 which locate against shoulders 49 and 50 of the bushing 38. The upper portion 51 of the hammer 37 is narrow enough to enter the bottom of the standard M16 upper receiver 26, yet wide enough internally to provide clearance for the upper portion 42 of the sear 31. The upper section 51 of the hammer terminates in the hammer block 55 which bridges the open ends of the aforementioned legs 45 and 46 and which may advantageously be fabricated of laminated sheet metal sections. The hammer block 55 has an inner radius 56 which allows clearance for rotation of the sear upper portion 42. The forward surface 57 of the hammer block 55 strikes the rear end of the firing pin (not shown) during firing, and the radius 58 at the inner edge of the forward surface 57 prevents the bolt carrier 112 from hooking the hammer block during cocking. The hammer block has a rearwardly projecting surface 59 which forms a locking hook for the surface 60 of the automatic sear 61, whereby the hammer 37 is retained in the cocked position shown in FIG. 1 until the automatic sear is released by forward movement of the bolt carrier 112 as described below. A stop 62 on the automatic sear 61 rests on ledge 63 that is present on the right side of the lower receiver housing, to limit rearward movement of the automatic sear.

Figure 4:
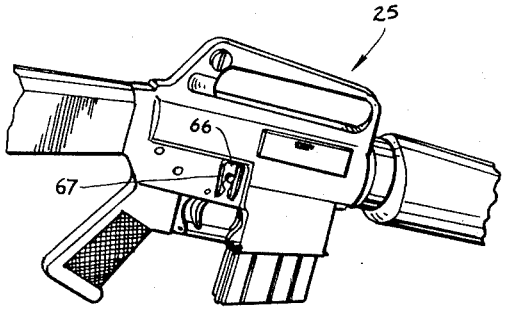
FIG. 4 is a fragmentary pictorial view of an M16 receiver, showing the locking arrangement for the sear/hammer pin.

The sear-hammer bushing 38 has a cylindrical opening through which is received the sear-hammer pin 64. The sear-hammer pin 64 is configured to fit within the existing M16 hammer pin hole (not shown), and the sear-hammer pin has a circumferential slot 65 which extends on the exterior of the lower receiver right side for engagement with the pin retainer 66, as shown in FIG. 4. The pin retainer 66 is preferably made of thin spring steel, and has a pair of legs 67 which are resiliently spreadable to snap over the sear-hammer pin 64 for retention within the slot 65. It will be appreciated that the sear 31, the hammer 37, the sear-hammer bushing 38, and the hammer springs 44*a* and 44*b* provide a subassembly which can be installed or removed in the rifle, in substitution of the conventional M16 hammer. The width 68 of the hammer 37 locates against the inside walls of the lower receiver trigger housing recess.

The sear 31 includes a projection 71 located below the sear-hammer bushing 38, and best seen in FIG. 1, which retains the sear spring 72. The sear 31 has a surface 73 located immediately above the mating surface 74 of the trigger 75, so that the sear can be locked against firing movement when the trigger is locked by application of the safety, as described below. The radius 77 of the sear 31 prevents jamming of the sear and the trigger surface 74 during firing, yet permits engagement of the sear with the trigger to prevent the sear from dropping below the trigger and becoming permanently jammed out of engagement.

The sear 31 has a firing contact surface 78 located behind the sear axis of rotation about the sear-hammer bushing 38, and the firing contact surface 78 is contacted by the curved forward portion 79 of the connector 80.

The connector 80 is retained within the slot 81 of the trigger 75 by the pin 88, which allows the connector to rock back and forth within the slot. Also mounted within the slot 81, at a position rearwardly of the connector 80, is the disconnector 82 which is mounted for rocking motion by the pin 83. The disconnector 82 has a lower forward surface 84 in underlying spaced-apart relation with the rearward underlying surface 85 of the connector 80, and the connector-disconnector spring 86 is positioned between the surfaces 84 and 85 to urge the connector 80 and the disconnector 82 in opposition to each other. The connector 80 has a rearwardly-extending surface 86 which contacts the upper surface 87 of the disconnector 82.

Extending from the rear of the disconnector 82 is the selector engaging member 91 which somewhat resembles the shape of a scorpion tail, and which is disposed beneath the shank of a conventional M16 firing selector lever 92, so that the selector engaging member 91 engages the selector lever 92 when the latter is set on semi-auto, and so that the selector engaging member 91 enters the automatic sear recess of the selector lever when set on full-auto.

The bolt carrier of a conventional closed-bolt M16 rifle is retained in the open position upon firing the last round in a magazine, and the bolt carrier is released by manually operating the bolt catch 94 after a fresh magazine is inserted into the lower receiver. Since the bolt carrier 112 of the present open bolt conversion is always retained in the open or rearward position, however, the open bolt rifle may appear to be ready to fire even while the bolt carrier is engaged by the bolt catch. This problem is overcome by providing an automatic bolt catch extension 95 which overlies the conventional magazine catch 96. The magazine catch 96 is moved outwardly when the magazine catch button (not shown) on the right side of the firearm is depressed, and the magazine catch contacts the automatic bolt catch extension 95 to operate the bolt catch 94 and thereby to release the bolt carrier 112. The bolt carrier 112 is now released to move forwardly a short distance until the bolt carrier surface 29 contacts the sear surface 30, whereupon the bolt assembly is ready for firing upon insertion of a fresh magazine.

The open bolt conversion as described with respect to the foregoing embodiment functions as follows. The bolt carrier is pulled backward in the conventional manner, and the bolt carrier pushes the hammer 37 to the cocked position in which the surface 59 of the hammer is engaged by the surface 60 of the automatic sear 61. The sear spring 72 moves the sear 31 upwardly, and the sear surface 30 engages the forward surface 29 on the underside of the bolt carrier 112, holding the bolt carrier at the cocked position shown in FIG. 1. If the selector lever 92 is set on "safe" at this time, the trigger 75 is locked in the normal M16 manner; such trigger locking also locks the surface 73 of the trigger beneath the surface 74 of the sear, thereby providing a double lock against firing while on safe.

Setting the selector lever 92 to the conventional full-auto position allows the trigger 75 to be depressed. The selector engaging member 91 of the disconnector 82 is carried upwardly within the automatic sear recess of the selector lever, and the surface 87 of the disconnector remains in contact with the surface 86 of the connector 80, so that the connector pivots about the trigger pin 88 along with the trigger 75. The forward portion 79 of the connector depresses the firing contact surface 78 of the sear 31, lowering the sear surface 30 from the surface 29 of the bolt carrier 112 and allowing the bolt carrier to move forward. The bolt carrier feeds a round from the magazine into the chamber, and the bolt locks in the conventional manner. Final forward movement of the bolt carrier 112 causes the forward surface 122 of the automatic sear release 113 (or a fixed projection on the bolt carrier of an M16 which lacks the present cyclic rate reducer apparatus) to engage and trip the automatic sear 61, allowing the hammer 37 to move up and forward under pressure of the hammer springs 44*a* and 44*b*, so that the hammer strikes the firing pin and the weapon fires in the normal manner. Recoil movement of the bolt carrier 112 again cocks the hammer 37, and the firing cycle is repeated as long as the trigger is held depressed. Releasing the trigger allows the sear spring 72 to raise the sear 31 to the upright position shown in FIG. 1, to stop the bolt carrier. The sear spring 72 also returns the trigger 75, through the connector 80 and disconnector 82, to the forward position.

When the selector lever 92 is set at semi-auto firing position, it will be recalled that the selector engaging member 91 of the disconnector 82 is moved upwardly into engagement with the selector lever when the trigger 75 is pulled rearwardly. The rear of the disconnector 82 is thereby depressed and the disconnector pivots about the pin 83, causing the surface 87 of the disconnector to move out from under the overhanging surface 86 of the connector 80 as the sear 31 is moved downwardly to release the bolt assembly 28 for its forward movement. The sear spring 72 is much more powerful than the connector-disconnector spring 89, so that the sear 31 moves up when permitted by movement of the bolt assembly, while rocking the connector 80 rearwardly about the trigger pin 88 and compressing the connector-disconnector spring 89. The sear surface 30 is thus returned into position to engage the surface 29 of the bolt assembly after the bolt assembly moves rearwardly upon recoil, so that only a single round is fired. When the trigger is released, the connector-disconnector spring 89 returns the trigger to forward position so that the disconnector 82 is lowered and the disconnector surface 87 reengages the surface 86 of the connector. The weapon is again ready to fire when the trigger is pulled.

CYCLIC RATE REDUCER APPARATUS

Figure 5:
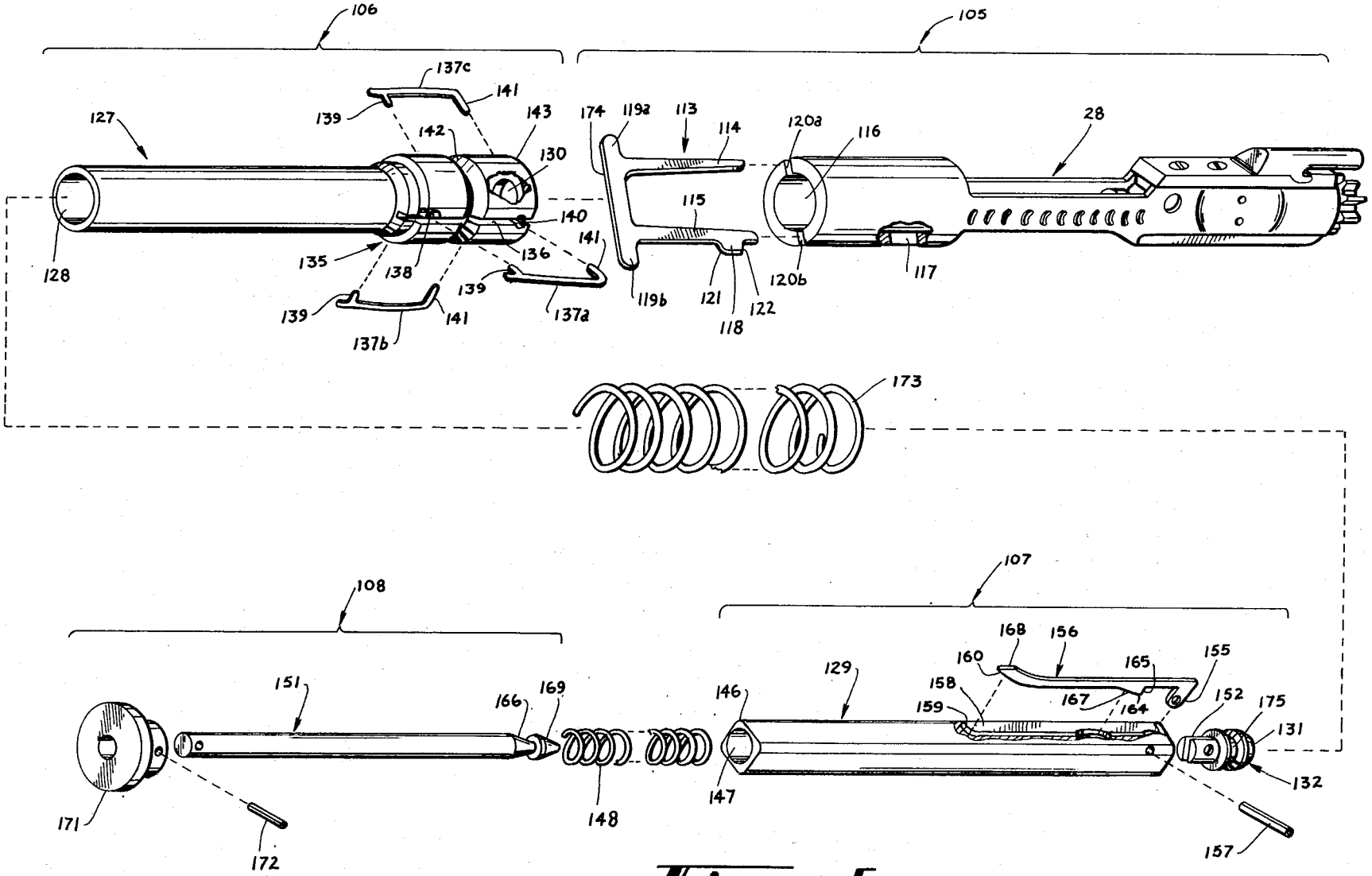
FIG. 5 is an exploded view showing the components of the cyclic rate reduction apparatus of FIG. 1.

The disclosed embodiment of the present cyclic rate reducer is shown installed in the M16 rifle 25 in FIGS. 1 and 5, and it is apparent that this rifle is also equipped with the open bolt firing mechanism as described above. It will become apparent from the following description, however, that the present cyclic rate reducer apparatus is equally applicable to a conventional closed-bolt M16 rifle as well as to the open bolt conversion previously described herein.

The cyclic rate reducer apparatus of the disclosed embodiment includes a modified bolt carrier assembly 105, an action spring guide assembly 106, an actuator asssembly 107, and a buffer assembly 108. The modified bolt carrier assembly replaces the conventional M16 bolt carrier assembly; while the action spring guide assembly 106, the actuator assembly 107, and the buffer assembly 108 replace the action spring guide assembly and buffer associated with the conventional M16.

Figure 6:
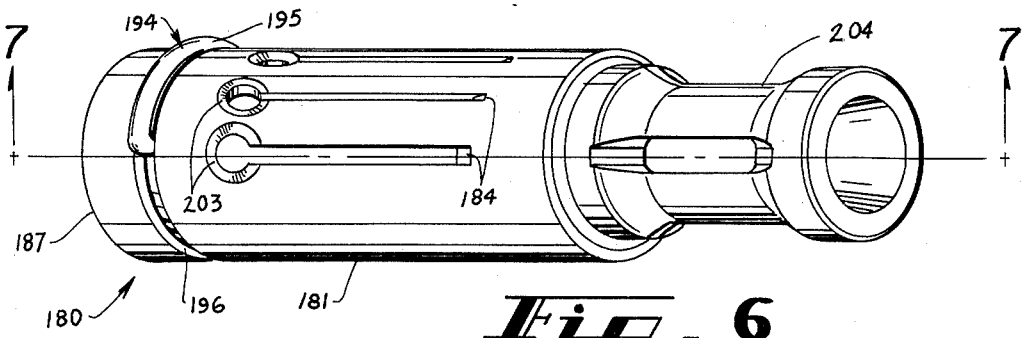
FIG. 6 is a pictorial view of a variable vector muzzle compensator according to a disclosed embodiment of the present invention.
Figure 7:
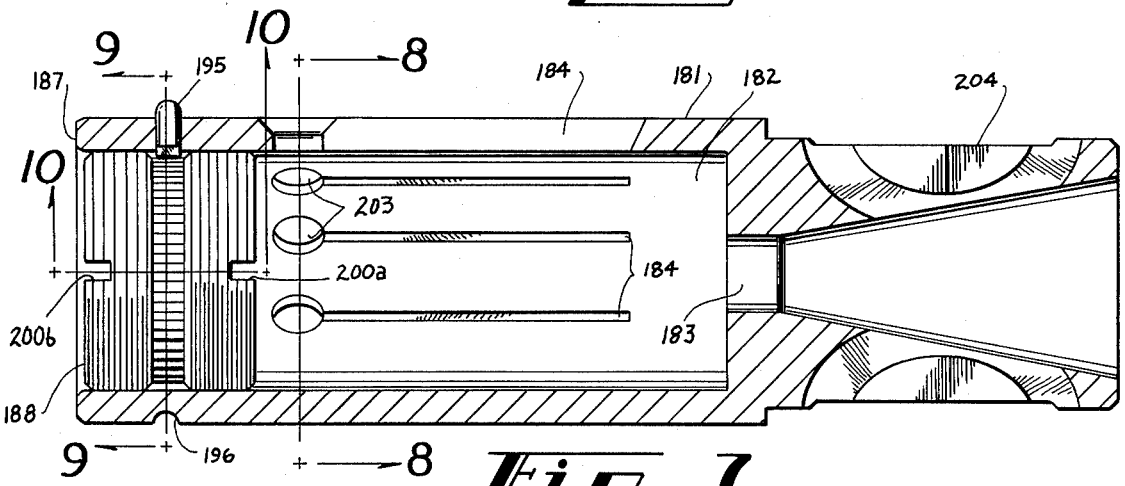
FIG. 7 is a section view taken along line 7—7 of FIG. 6.
Figure 8:
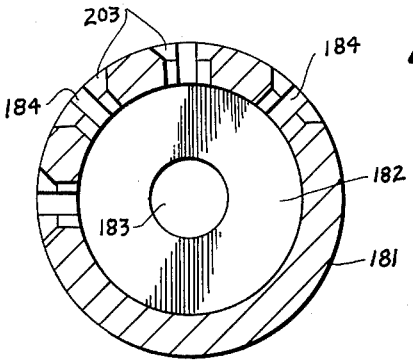
FIG. 8 is a section view taken along line 8—8 of FIG. 7.
Figure 9:
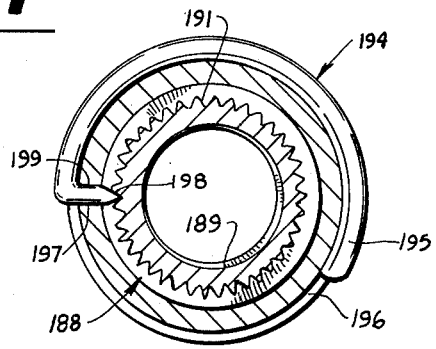
FIG. 9 is a section view taken along line 9—9 of FIG. 7, showing the detent locking arrangement.
Figure 10:
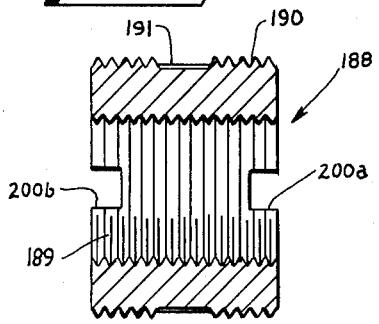
FIG. 10 is a section view showing the locking and detachment bushing of the variable vector muzzle compensator.
Figure 11:
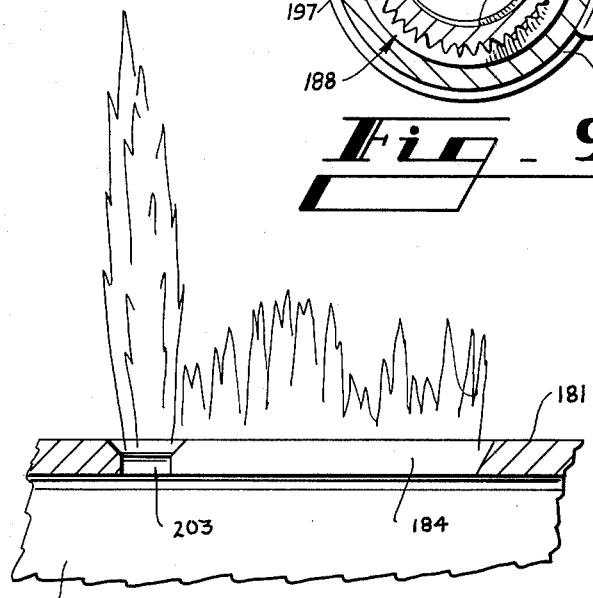
FIG. 11 is a fragmentary view of the disclosed muzzle compensator in operation, showing the shielding effect of a gas labyrinth provision.

The modified bolt carrier assembly 105 includes a bolt carrier 112 which is a standard M16 bolt modified to remove the surface that normally trips the M16 automatic sear, and to accept the automatic sear release 113 at the rear of the bolt carrier. The automatic sear release 113 is a unitary horseshoeshaped member made of spring steel, and having a pair of generally parallel legs 114 and 115 that bend inwardly to fit within the opening 116 at the enlarged rear portion of the bolt carrier 112. A slot 117 in the lower rear portion of the bolt carrier 112 receives the projection 118 extending outwardly from the leg 115 of the automatic sear release. Flanges 119*a* and 119*b* mate with slots 120*a* and 120*b* in the rear of the bolt carrier 112, and it can be seen from FIG. 6 that the slots 120*a* and 120*b* lie along an angle that prevents the bottom flange 119*b* from striking the standard buffer retainer of the M16 lower receiver. The automatic sear release 113 is installed on the bolt carrier 112 by bending the legs 114 and 115 inwardly to fit within the opening 116, after which the automatic sear release is inserted within the hole 116 until the projection 118 snaps into the slot 117 to retain the automatic sear release in assembly with the bolt carrier 112. The radius 121 on the back of the projection 118 aids in removal of the automatic sear release from the bolt carrier. The forward surface 122 of the projection 118 is the new tripping surface for the M16 automatic sear. The slot 117 is somewhat longer than the longitudinal extent of the projection 118, so that the automatic sear release can undergo a limited extent of longitudinal movement relative to the bolt carrier 112. Forward movement of the automatic sear release 113 is restricted by contact of the flanges 119*a* and 119*b* with the bottoms of the corresponding slots 120*a* and 120*b*.

The action spring guide assembly 106 includes an action spring guide 127 which is cylindrical and is similar in shape to the standard M16 guide (or standard buffer, in recent terminology), and the guide 127 has an inside cylindrical passage 128 that accepts the outside diameter of the actuator 129. The action spring guide 127 has an opening 130 of reduced diameter at the front end, to allow passage of the outside diameter 131 of the actuator cap 132.

Three slots parallel to the longitudinal axis of the action spring guide 127 are provided in the larger diameter 135 at the forward end of the guide, with only one such slot 136 being visible in FIG. 5. Each of these three slots accepts a corresponding anti-bounce finger spring 137*a*, 137*b*, and 137*c*, and a small hole 138 adjacent the bottom rear of each slot accepts a mating projection 139 adjacent the rear of each antibounce finger spring. The projections 139 are a tight mating fit within the corresponding holes 138, so as to position the fore-and-aft location of each finger spring within the corresponding slot of the action spring guide 127. A hole 140 adjacent the bottom front of each slot 136 is a clearance hole for the elongated right-angle projection 141 at the front of each finger spring 137*a*, 137*b*, and 137*c*.

The three finger springs are retained within the corresponding slots by retaining means which fits within the annular groove 142 around the larger diameter 135. Such retaining means can be provided by a wire wrap 144 which is securely wound about the annular groove 142 over the finger springs. In assembly, the projections 141 of the three finger springs extend into the opening 130 of the action spring guide 127 in longitudinally staggered position, so that each of the projections is a slightly different distance from the front 143 of the action spring guide.

The actuator 129 is square in cross section, with the corners 146 being rounded to form an outside diameter which slidingly fits within the cylindrical passage 128 of the action spring guide 127. A cylindrical passage 147 opening from the rear of the actuator 129 accepts the compression coil spring actuator 148 which engages the internal counterbore 149 (FIG. 1), while an opening 150 of smaller diameter within the forward portion of the actuator 129 accepts the outside diameter of the actuator spring guide 151 and also the inner end 152 of the actuator cap 132. The slotted inner end 152 receives the projection 155 of the actuator catch 156, and a pin 157 extends through mating holes in the forward end of the actuator 129, the slotted inner end 152 of the actuator cap 132, and the projection 155 to retain the actuator cap at the front end of the actuator.

The actuator has a longitudinal slot 158, extending rearwardly from the forward end of the actuator along the upper surface thereof, which accepts the elongated actuator catch 156. The slot 158 has a curved rearward surface 159 which provides a stop for the mating lower surface 160 of the actuator catch 156.

A projection 164 on the underside of the elongated actuator catch 156 has a forward-facing angulated surface 165 that mates with the conical groove 166 at the forward end of the action spring guide 151, while the rearwardly facing angulated surface 167 of the projection 164 mates with the conical nose 169 of the action spring guide. The actuator catch 156 is slightly longer than the slot 158 so that the free end 168 of the actuator catch engages and slides along the wall of the cylindrical passage 128.

The buffer assembly 108 includes the buffer 171 which is secured to the rear end of the action spring guide 151 by the pin 172 extending through mating openings.

The cyclic rate reducer apparatus is installed in an M16 rifle by replacing the conventional bolt carrier with the modified bolt carrier assembly 105, after which the action spring and standard buffer/action spring guide are removed. The actuator assembly 107, actuator spring 148, and buffer assembly 108 are inserted into the rear of the action spring 173, and the action spring guide assembly 106 is inserted into the front of the action spring. The entire subassembly is inserted into the buttstock, and the upper receiver is closed.

The cyclic rate reducer apparatus operates in the following manner. Assuming the weapon has just fired, the bolt carrier assembly recoils in the normal manner, compressing the action spring 173 and the actuator spring 148. As the actuator 129 moves rearwardly, the surface 167 of the actuator catch 157 strikes the conical nose 169 of the action spring guide 151. Since the free end 168 of the actuator catch is within the cylindrical passage 128 of the action spring guide 127 at this time, the midsection of the actuator catch 156 bows upward slightly to permit the projection 164 to ride over the conical nose 169 and snap into the conical groove 166.

At this point (FIG. 1) the bolt carrier assembly 105 and the actuator assembly 107 strike the buffer 171, and the two assemblies start to move forward in counter-recoil. The actuator assembly 107 is retained by engagement of the actuator catch with the actuator spring guide as aforementioned, and so the bolt carrier 105 and the action spring guide assembly 106 move forward under pressure of the action spring 173. As the action spring guide 127 moves forward under force of the action spring 173, the actuator 129 is withdrawn from the passage 128 until the free end 168 of the actuator catch 156 is no longer within the actuator spring guide. Since the actuator 129 is being urged forwardly by the actuator spring 148, the projection 164 rides upwardly out of the conical groove 166 in the action spring guide 151 and the actuator assembly travels forwardly within the actuator spring guide 127 until the nose of the actuator cap 132 extends through the opening 130 in the forward end of the actuator spring guide assembly and strikes the rear surface 174 of the automatic sear release 113. The automatic sear release moves forwardly within the bolt carrier 112 so that the forward surface 122 of the projection 118 strikes the automatic sear of the firearm to release the hammer, whereupon the automatic firing cycle continues as long as the trigger is pulled.

It will be understood that the forward movement of the actuator assembly 107, which commences after the bolt carrier assembly 105 is home and locked, provides the time delay that is added to the normal cycle time of the M16 to lower the cyclic rate of fire.

The actuator cap 132, during its final travel forward, cams the projections 141 of the three anti-bounce finger springs 37*a*, 37*b*, 37*c* out of the way. The projections 141 then snap into the groove 175 and retain the actuator cap to prevent the actuator from bouncing rearwardly prior to recoil movement of the bolt carrier assembly. The aforementioned staggered position of the projections 141 exerts a graduated pressure buildup on the groove 175 to overcome the aforementioned bounceback force, while still permitting the projections 141 to be resiliently cammed out of the groove, one at a time due to the staggered location, at the time of counter-recoil separation under force of the action spring 173.

VARIABLE VECTOR MUZZLE COMPENSATOR

The variable vector nuzzle compensator is shown generally at 180, in FIGS. 6–11, and includes a generally cylindrical body 181 having a hollow interior chamber 182 with a forward opening 183 of the diameter at least sufficient to permit unimpeded passage of a bullet.

A number of elongated slots 184 are formed in the top peripheral portion of the body 181, and it is important that the slots 184 be assymetrically disposed about a plane perpendicular to the longitudinal axis of the body.

The rear end 187 of the internal chamber 182 is threaded to receive the externally-threaded bushing 188. Internal threads 189 on the hollow bushing 188 mate with external threads at the muzzle of a firearm, and it will be apparent that the internal threads 189 can mate with the threads of an M16 muzzle that normally accept the conventional flash suppressor.

The threaded exterior surface 190 of the bushing 188 is interrupted by a peripheral band of parallel and longitudinally-extending teeth 191, which may be provided by a straight knurl about the exterior of the bushing. The teeth 191 are engaged within the body 181 by a spring detent 194 having an over-semicircular diameter 195 that snaps into the annular groove 196 formed in the exterior of the body. The spring detent 194 has an inwardly-turned finger 197 terminating in a chisel point 198 that engages the teeth 191 extending about the bushing 188. The spring detent 194 exerts an inward bias on the finger 197, extending through the hole 199 through the body within the groove 196, allowing for a circular "click" adjustment of the body with respect to the bushing 188. The bushing 188 has slots 200*a*, 200*b* at each end, for installing and removing the variable vector muzzle compensator.

The rear end of each slot 184 terminates at a hole 203 extending into the chamber 182. A standard slotted flash suppressor 204 may be fitted at the forward end of the compensator body 181, if desired.

When a firearm fitted with the variable vector muzzle compensator 180 is fired, especially in full-auto fire, gas escapes from the muzzle and expands within the chamber 182 of the compensator. The gas escapes through the slots 184 at the top of the body 181, thereby causing a reaction force having a downward vector which urges the compensator and the firearm muzzle downwardly, in opposition to the normal tendency of the firearm to climb upwardly as the shooter starts bending at the waist. By rotating the body 181 about the click-stop adjustment with respect to the bushing 188, the angle of the downward force vector can be adjusted to compensate for the tendency of the firearm to rotate the shooter's body as the weapon is fired on full-auto. The holes 203 at the rear ends of the slots 184 provide upwardly-directed jets of gas to form a gas labyrinth at each slot that prevents gas from blowing to the rear and into the shooter's face.

MULTIPLE MAGAZINE APPARATUS

The multiple magazine apparatus of the embodiment shown in FIGS. 12–17 holds three thirty-round M16 magazines in a semi-permanent assembly. It should be understood that the disclosed number and type of magazines is only illustrative, and that other types of magazines and any reasonable plural number of magazines can be accommodated in an assembly of the same kind.

Figure 12:
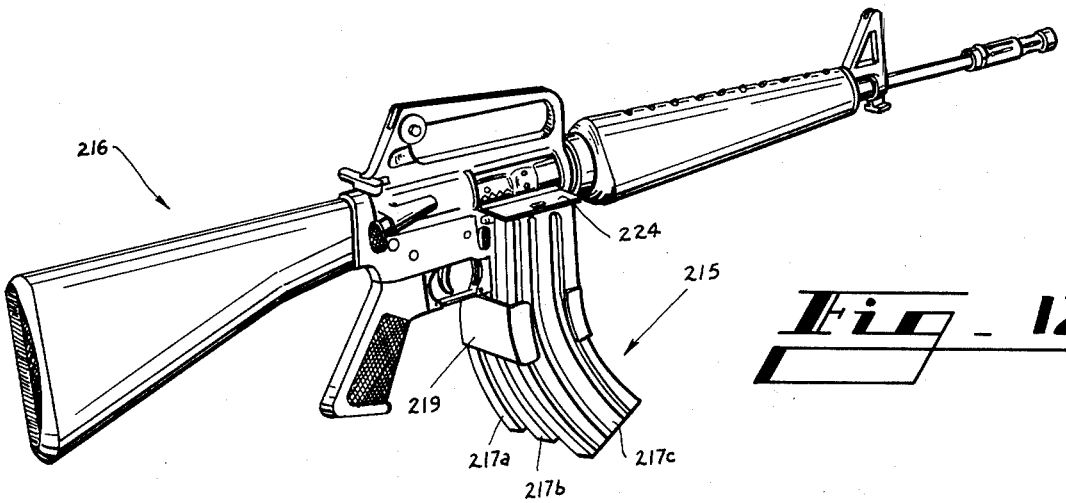
FIG. 12 is a pictorial view of a disclosed embodiment of multiple magazine assembly, shown in use with an M16 rifle.
Figure 13:
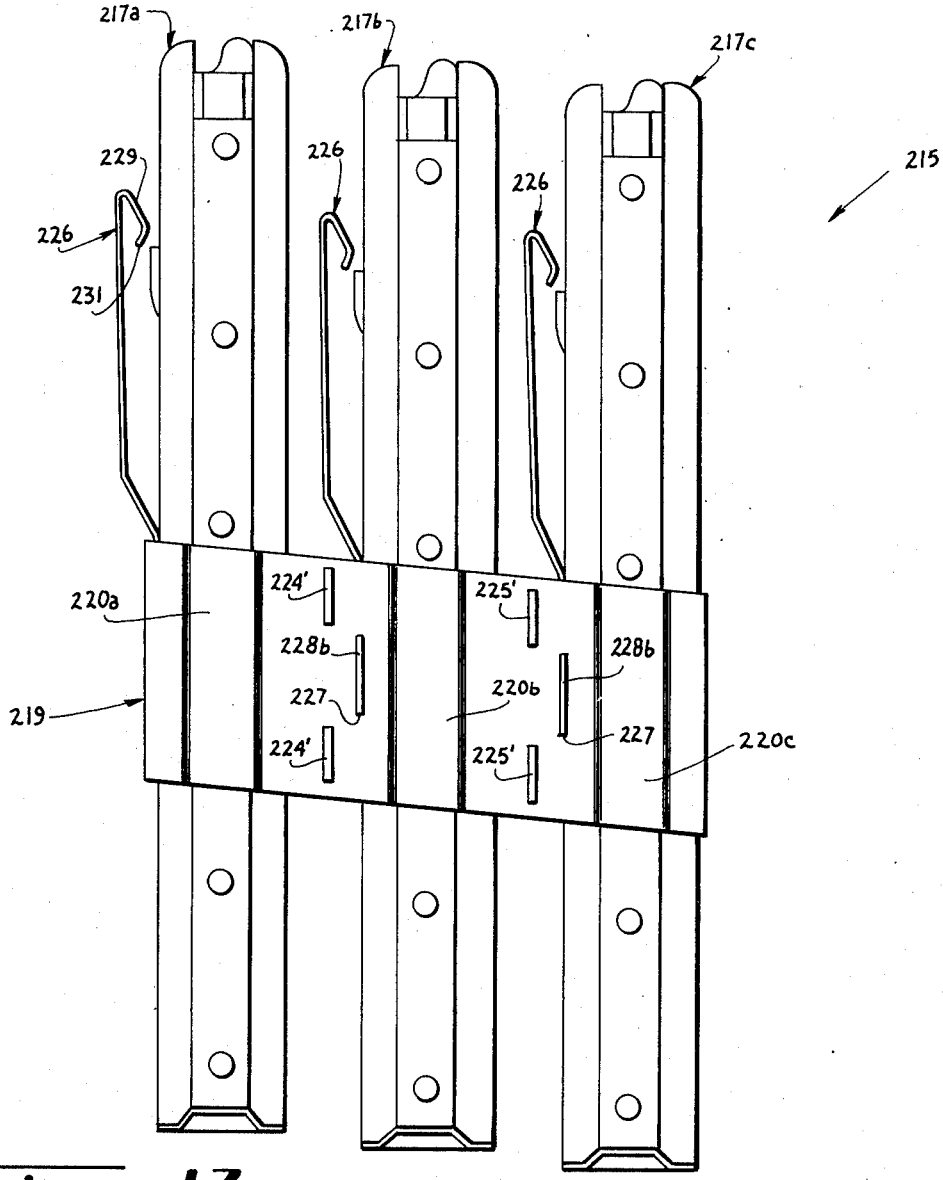
FIG. 13 is a rear elevation view of the multiple magazine assembly shown in FIG. 12.
Figure 17:
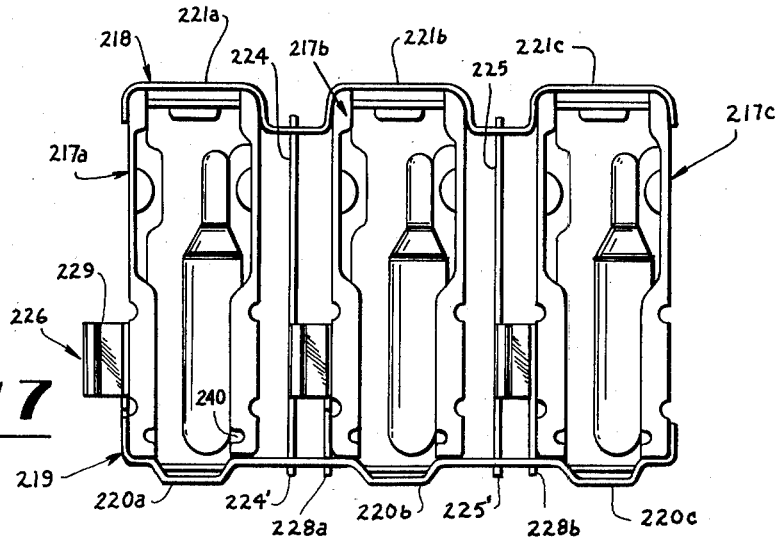
FIG. 17 is a top plan view of the overall disclosed multiple magazine assembly.

The multiple magazine assembly indicated generally at 215 and shown with one magazine attached to a M16 216 in FIG. 12, includes three magazines 217*a*, 217*b*, and 217*c*. The three magazines are supported in spaced-apart side-by-side relationship, as best seen in FIGS. 13 and 17, by a front bracket 218 and a rear bracket 219, each of which can be fabricated from a single piece of sheet metal. Channels 220*a*, 220*b*, and 220*c* which locate the corresponding magazines, and similar channels 221*a*, 221*b*, and 221*c* are provided in the front bracket 218.

Figure 14:
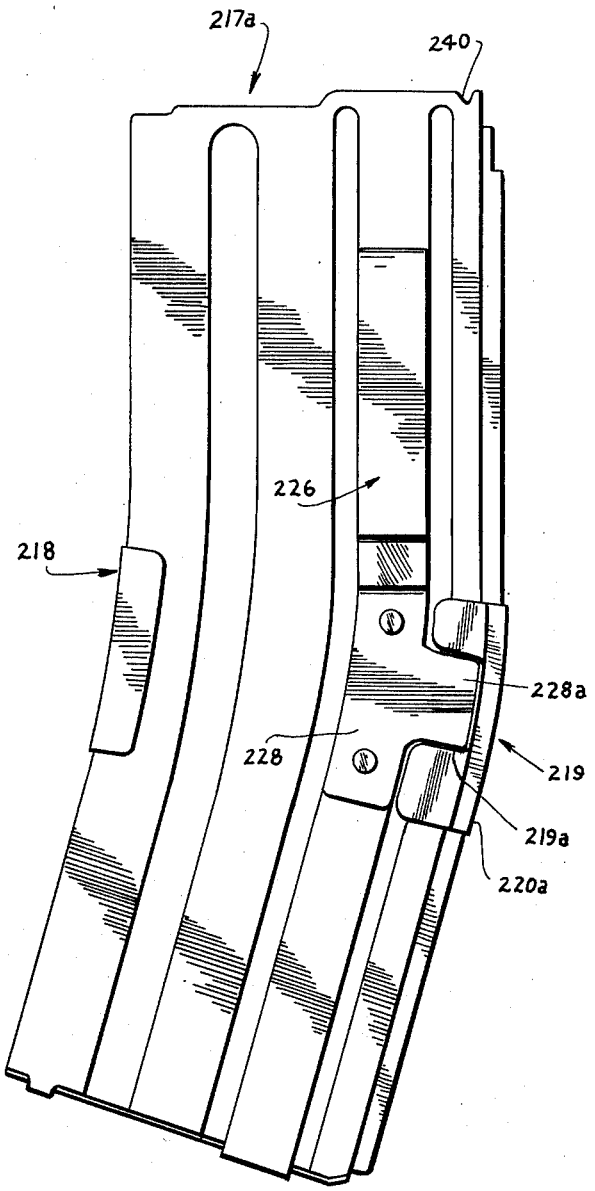
FIG. 14 is a left side elevation view of the disclosed multiple magazine assembly embodiment.
Figure 15:
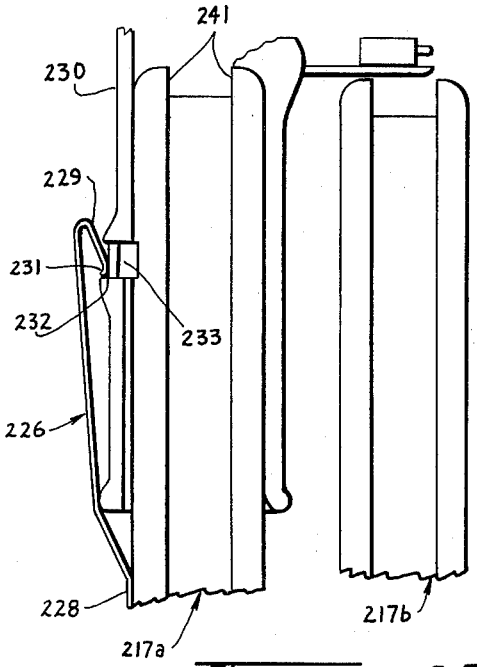
FIG. 15 is a fragmentary rear elevation view of the disclosed multiple magazine assembly, showing one magazine attached to the rifle receiver.
Figure 18:
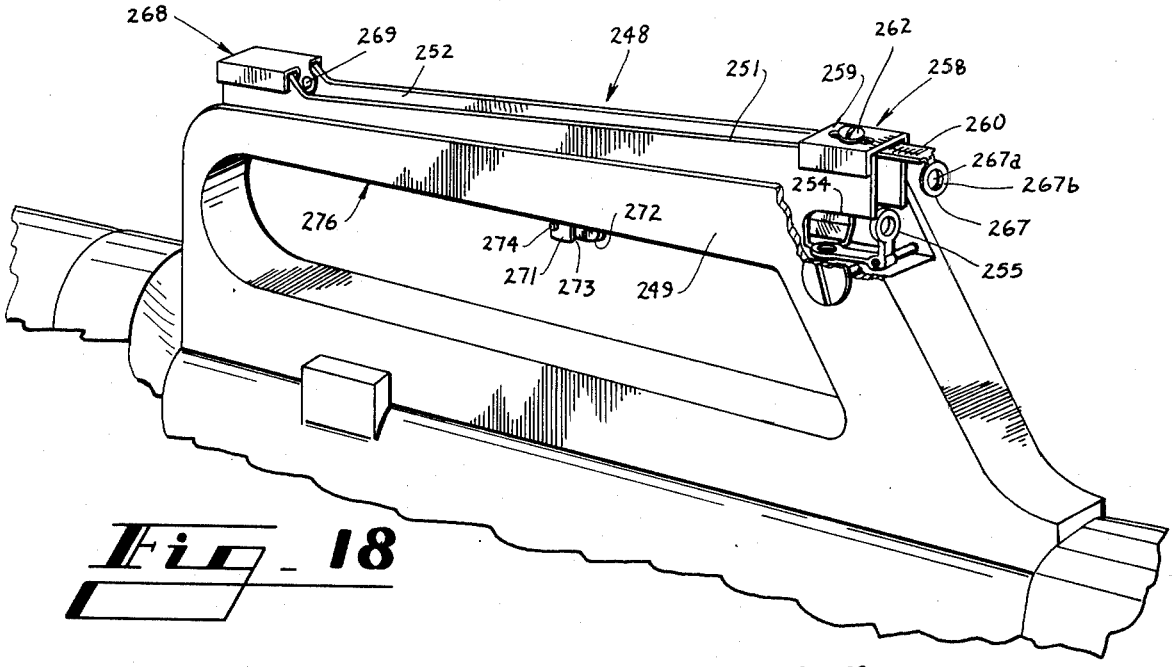
FIG. 18 is a pictorial view of night sight apparatus according to a disclosed embodiment of the present invention, showing the sight in use on a conventional M16 rifle.

The front and rear brackets are secured together by two spacing plates 224 and 225, best seen in FIG. 18, that are interposed between the magazines 217*a* and 217*b*, and between 217*b* and 217*c*, respectively. Each spacing plate 224 and 225 has four tabs, two at each of the front and back ends, that mate with corresponding slots in the front and rear brackets. Two such tabs 224' for the spacing plate 224 are shown in FIG. 14, while corresponding tabs 225' are shown for the spacing plate 225. The front and rear tabs of the two spacing plates are peened or otherwise secured to the corresponding front bracket 218 and rear bracket 219 to hold together the multiple magazine assembly.

Figure 16:
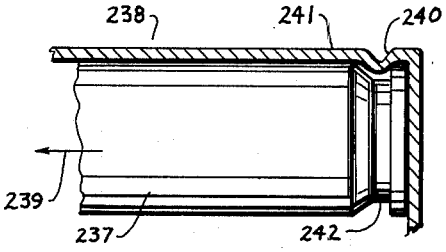
FIG. 16 is a fragmentary top view of a typical magazine in the multiple magazine assembly of the present invention, showing the top-round retention feature.

Each of the magazines 217*a*–217*c* has an auxiliary magazine catch 226 which engages an external recess on the lower receiver of the firearm, to assist in supporting the weight of the multiple magazine assembly. The auxiliary magazine catch in the disclosed embodiment is a unitary strip of spring steel having a lower portion 228 that is secured to the side of the individual magazine 218 by rivets or the like, and which extends upwardly to the cam surface 229 which guides the magazine catch over and outside of the magazine housing 230 of an M16 lower receiver, as shown in FIG. 16, during insertion of the magazine. Tabs 228*b* and 228*c* extend through slots 227 in rear bracket 219, and tab 228*a* fits within slot 219*a* in the left flange of rear bracket 219, to locate the auxiliary magazine catches. The cam surface 229 terminates in a downwardly-facing hook 231 which engages the bottom surface of the magazine catch recess 232 on the lower receiver housing 230. When the magazine catch release 233 of the rifle is operated to release the magazine in the normal manner, the cam surface 229 is moved out of the recess 233 so that the entire multiple magazine assembly can be moved downwardly to withdraw the particular magazine from the lower receiver.

As best shown in FIGS. 12 and 13, the several magazines 217*a*–217*c* are mounted by channels 220*a*–220*c* in a downwardly-stepped relation from left to right, as viewed from the rear, so that the ejection port dust cover 224 of an M16 216 can open enough to allow empty rounds to eject without interference from adjacent magazines of the multiple magazine assembly.

Recoil force furing firing tends to cause the top round 237 (FIG. 16) of each magazine not in the receiver housing to become dislodged forwardly, in reaction to the rearward movement of the magazine assembly caused by recoil. This unwanted movement of the top round 237 relative to an unhoused magazine 238 is shown by the arrow 239, although it will be understood that the magazine 238 actually moves rearwardly during firing relative to the top round, which tends to remain stationary of its own inertia. This top round dislodgment problem is overcome by providing indentations 240 in the lips 241 adjacent the back end of each magazine. The indentations 240 engage the extraction cannulation 242 of the top round 239. The cam-shaped surface of the indentation 240 allows the bolt of the firearm to override magazine spring pressure and move the top round forwardly during feeding of each round from the magazine.

NIGHT SIGHT APPARATUS

Figure 19:
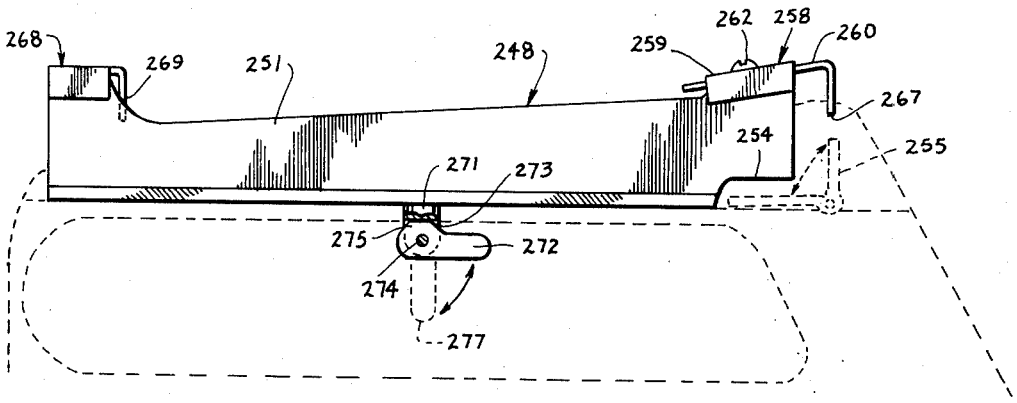
FIG. 19 is a side elevation view of the embodiment shown in FIG. 18.
Figure 20:
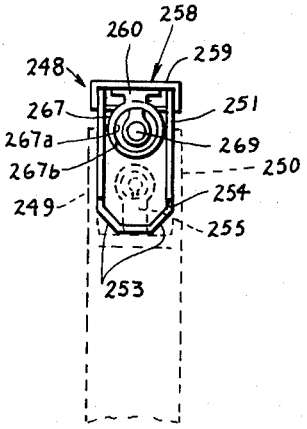
FIG. 20 is a rear elevation view of the embodiment shown in FIG. 18.
Figure 21:
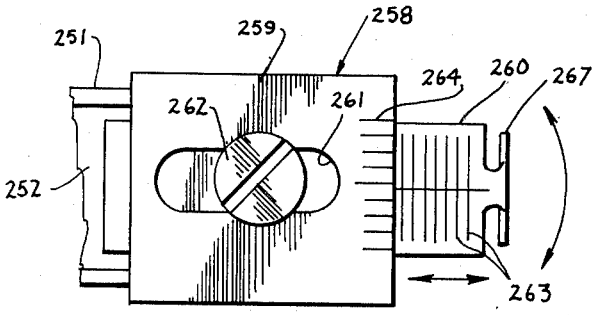
FIG. 21 is a fragmentary plan view of the rear sight of the embodiment shown in FIG. 18.

The disclosed embodiment of the present night sight is a single unit 248 which closely fits between the two ears 249 and 250 on the handle of an M16 upper receiver, although it should be understood that the specific configuration of the present night sight can be adapted to accommodate other firearms. The night sight unit 248 includes a base 251 which is a unitary sheet metal stamping folded in a U-configuration to define an upwardly-open channel 252. The two angled surfaces 253 at the bottom of the base 251 mate with corresponding angles in the M16 upper receiver, to locate the night sight unit 248. As best seen in FIG. 19, the back end of the base 251 is cut away at 254 to avoid interfering with the standard M16 rear sight 255.

The rear sight 258 of the night sight unit includes a channel-shaped ramp 259 which is secured over the open channel 252 of the base 251, as by spot welding or the like. The angle of the ramp 259 forms an inclined plane along which the rear sight member 260 slides up and down to provide elevation adjustment of the night sight. A slot 261 is formed in the ramp 259, and the rear sight member 260 is connected beneath the slot by the screw 262 which fits through the slot and threads into the rear sight member. Graduation lines 263 on the rear sight member 260 form a scale for setting the amount of elevation with reference to the back edge of the ramp 259. Since the width of the rear sight member 260 is less than the width of the channel 252 within the base 251, the rear sight member may be pivotally moved to the left or right about the screw 262 to provide windage adjustment of the rear sight. Graduation lines 264 on the back edge of the ramp 269 provide a windage setting scale.

A sighting ring 267 depends downwardly from the rear sight member 260. The sighting ring 267 has a sighting aperture **267*a* which is surrounded by a ring 267*b*** of luminous material.

The front sight 268 is a channel member which is attached to the forward end of the base 251, and which includes a sighting target 269 extending downwardly within the channel 252. The target projection 269 has a spot of luminous material, and it will be understood that the target projection 269 is nominally aligned with the rear sighting aperture 267 and the line of fire for the particular firearm with which the night sight unit 248 is used.

A mounting shaft 271 is threaded into a mating hole in the bottom of the base 152 and extends downwardly for insertion through a corresponding hole in the M16 upper receiver section. The mounting shaft 271 is preferably nonremovably attached to the base 251 by staking the threads, or by another expedient. At the lower end of the mounting shaft 271 the thumbplate 272 is secured within the slotted lower end 273 of the mounting shaft 271 by the pin 274. The pin 274 retains the thumbplate 272 for rotational movement within the slot, as best seen in FIG. 19, and the angled surface 275 on the thumbplate provides a wedge that blocks the night sight to the underside of the upper receiver handle 276.

In operation, the night sight unit 248 is installed on the rifle by pivoting the thumbplate 272 to the phantom position 277 (FIG. 19) and inserting the night sight unit within the upper receiver handle 276. The thumbplate is then rotated 90° to the solid line position, and rotated along with the mounting shaft 271 to screw the night sight unit into snug engagement between the ears 249 and 250. The night sight is now installed, and can be used during daytime shooting as a regular rear-aperture/front-bead sighting system. The rear sight 258 can be adjusted in windage and elevation. During low light level operation, the night sight unit is used like a "single point" sight, in which the front and rear sights is observed with the shooting eye and the target is observed with the other eye. The luminous target projection 269 is centered within the luminous ring **267*b*** of the rear sight, for firing of the target.

It will be understood that the foregoing relates only to preferred embodiments of the present invention, and that numerous modifications and alternative embodiments may be provided without departing from the spirit and the scope of the invention as defined in the following claims.

I claim:

1. Open bolt firing mechanism for a firearm of the type including a receiver housing having a reciprocating bolt mechanism and a hammer-operated firing pin carried by said bolt mechanism; comprising:

sear means pivotally mounted within said receiver section;

said sear means having a bolt engaging surface to engage and retain said bolt mechanism in open position, and a second surface which engages said receiver housing in force transmitting alignment with said bolt engaging surface, so that forward force of said open bolt mechanism is transferred through said sear means to said receiver housing;

trigger means engagable with said sear means to pivotally move said sear means so that said bolt engaging surface is withdrawn from said bolt mechanism; and hammer means mounted for pivotal motion concentrically with and independently of pivotal motion of said sear means;

said hammer means having a pair of legs which extend alongside of said sear means, and a bridge portion which extends between said legs outwardly beyond said sear means, so that said hammer means can pivot without interference with said sear means to bring said bridge portion into firing contact with said firing pin when said bolt assembly has moved forward.

2. Apparatus for conversion to open-bolt firing of a firearm which is normally intended for closed-bolt firing and which has a receiver section, a reciprocating bolt mechanism within said receiver section, a hammer-operated firing pin carried by said bolt mechanism, and a firing selector having a recess selectably positionable for full-automatic firing to receive an automatic sear which is conventionally present in said firearm, or for semi-automaic firing, comprising:

sear means mounted within said receiver section and selectably operative to engage and retain said bolt mechanism in open position;

trigger means selectably engagable with said sear means to release said bolt mechanism for movement to a closed firing position;

hammer means disposed in said receiver section and selectably operative to strike said firing pin;

replacement automatic sear means which is substituted within said receiver section for said conventional automatic sear, and which is operative to retain said hammer in a cocked position and to release said cocked hammer in response to predetermined movement of said bolt mechanism, said replacement automatic sear being disposed in nonoperative relation with said recess of said firing selector;

a trigger;

connector means which is operative in response to trigger pull to withdraw said sear means from bolt engagement for full-automatic firing of said firearm;

disconnector means selectably connected between said trigger and said connector means, said disconnector means having a member which is located in relation to said firing selector to enter said recess when said trigger is pulled, provided that said firing selector is positioned for full-automatic firing; and said disconnector means being operative in response to engagement of said firing selector when in semi-automatic firing position to disconnect the operative connection between said connector means and said sear means, so that said sear means returns to bolt engaging position after firing a single round, irrespective of maintained trigger pull.

3. Apparatus as in claim 2, wherein:

said disconnector means is displaced by pull of said trigger for movement toward said firing selector, and said disconnector means is also pivotally movable with respect to said trigger in response to said engagement of said firing selector;

a spring operatively interposed between said connector means and said disconnector means, said spring urging said disconnector to assume a first position which engages said connector means to operate said sear means in response to trigger pull; and said disconnector means compresses said spring and moves to a second position for disengagement of said connector means, in response to said engagement of said firing selector in semi-automatic firing position, so that said sear means returns to bolt engaging position after firing a single round and said compressed spring provides a restoring force to said trigger through said disconnector means in opposition to trigger pull.

4. A sear-hammer subassembly for a firearm, comprising:

pivotable hammer means having a hammer member and a pair of generally parallel legs extending outwardly from said hammer member;

coaxial openings formed in said legs in spaced apart relation to said hammer member;

a hollow bushing inserted between said legs in alignment with said coaxial openings:

sear means mounted on said bushing between said legs for pivotable movement relative to said bushing; and at least one hammer spring surrounding said bushing between said legs and operatively engaged with at least one of said legs, so that the entire said subassembly can be inserted en bloc into a firearm and retained therein by a pin inserted through said bushing and said coaxial openings.

5. Open bolt firing mechanism for an M-16 firearm which includes a receiver housing having a front wall, a reciprocating bolt mechanism mounted within said receiver housing, and a hammer-operated firing pin carried by said bolt mechanism, comprising;

sear means;

means mounting said sear means for pivotable movement about the axis of rotation associated with the hammer of an unmodified M-16;

said sear means having a bolt engaging surface positioned above said sear mounting means and operative to engage and retain said bolt mechanism in open position, and having a second surface positioned above and in front of said mounting means to engage said front wall of said receiver housing when said bolt is engaged and retained in open position by said sear means, so that forwardly-directed force of said open bolt mechanism is transferred through said sear means to said front wall of said receiver housing by said second surface; and trigger means engagable with said sear means to pivotally move said sear means so that said bolt engaging surface is withdrawn from said bolt mechanism.

6. The firing mechanism as in claim 24, wherein said firearm includes a bolt catch which retains said bolt mechanism in a non-fireable open position independently of said bolt engaging surface of said sear means in response to firing the last round in a magazine, magazine release means operative to withdraw a magazine from said firearm, and means operative in response to operation of said magazine release means to release said bolt catch so that said bolt mechanism can move forward into engagement with said sear means for retention in a fireable open position by said sear means.

* * * * *

UNITED STATES PATENT OFFICE

CERTIFICATE OF CORRECTION

Patent No. 4,057,003 Dated November 8, 1977

Inventor(s) Maxwell G. Atchisson

It is certified that error appears in the above-identified patent and that said Letters Patent are hereby corrected as shown below:

Column 14, line 26, change claim reference numeral "24" to --5--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*